US005926902A

United States Patent [19]

Pierre

[11] Patent Number: 5,926,902

[45] Date of Patent: Jul. 27, 1999

[54] HAIRBRUSHES, COMBS, OR THE LIKE HAVING A CLEANING PLATE

[76] Inventor: A. Joseph Pierre, 1 Dean Park Road, Suite No. 1602, Toronto, Ontario, Canada, M1B 2W5

[21] Appl. No.: 09/086,460

[22] Filed: May 29, 1998

[51] Int. Cl.[6] ..... A45D 24/40; A46B 17/06

[52] U.S. Cl. ..... 15/169; 15/160; 15/246; 132/119; 119/628

[58] Field of Search ..... 15/160, 169, 246; 132/119; 119/628

[56] References Cited

U.S. PATENT DOCUMENTS

| | | | |
|---|---|---|---|
| 31,727 | 3/1861 | McClure | 15/246 |
| 1,303,500 | 5/1919 | Rosenberg | 15/246 |
| 2,529,927 | 11/1950 | Fisk | 15/159.1 |
| 2,553,242 | 5/1951 | Dombitsky | 15/246 |
| 3,108,305 | 10/1963 | Peilet | 15/169 |
| 3,110,053 | 11/1963 | Surabian | 15/159.1 |
| 3,172,139 | 3/1965 | Wire | 15/160 |
| 3,577,580 | 5/1971 | Rand | 15/169 |
| 3,737,936 | 6/1973 | Uosaki | 15/169 |
| 3,886,617 | 6/1975 | Labran et al. | 15/169 |
| 4,517,703 | 5/1985 | Koke | 15/246 |
| 4,932,425 | 6/1990 | Chen | 132/119 |
| 5,519,912 | 5/1996 | Kawamura | 15/160 |
| 5,600,865 | 2/1997 | Morrison | 15/169 |
| 5,603,137 | 2/1997 | Hasan | 15/176.1 |

*Primary Examiner*—Mark Spisich
*Assistant Examiner*—Theresa T. Snider
*Attorney, Agent, or Firm*—Bereskin & Parr

[57] ABSTRACT

This invention relates to hairbrushes, combs, or other like hairdressing implements, that have a cleaning plate to remove debris, such as hair, dandruff, or other material, that collects between the bristles during use. The preferred embodiment of this invention provides for a hairbrush having a base and a plurality of bristles extending away from the base. A cleaning plate is provided having a cleaning element that can be slideably disposed near the base between adjacent pairs of bristles so that it can be displaced away from the base to remove hair, dandruff or other debris that collects between the bristles during use of the hairbrush. A releasable lock is also provided to releasably secure the cleaning plate to the base of the hairbrush. The releasable lock includes a first locking part on at least one of the plurality of bristles, and a complimentary second locking part to the first locking part on the cleaning plate. This complementary second locking part is positioned to releasably engage the first locking part when the cleaning element is slideably disposed near the base between adjacent pairs of bristles. In the preferred embodiment, the first locking part on at least one of the plurality of bristles is a stem which the complimentary second locking part releasably engages. In particular, the complimentary second locking part comprises a channel having a sufficient width to releasably engage in snug fit the stem of the first locking part. Moreover, the first locking part includes a stop located on the stem above where the complimentary second locking part releasably engages the stem. The stop engages the second locking part from above to prevent the cleaning plate from being displaced away from the base when the channel releasably engages in snug fit the stem of the first locking part. In the preferred embodiment, the stem and the stop of the first locking part are integrally formed with the respective bristles of the hairbrush.

15 Claims, 4 Drawing Sheets

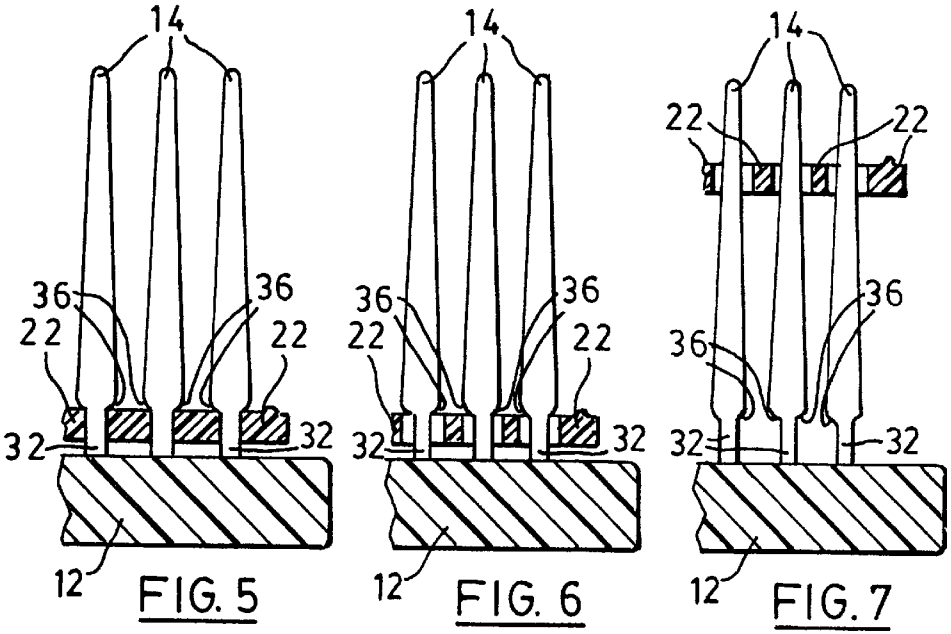
FIG. 5
FIG. 6
FIG. 7
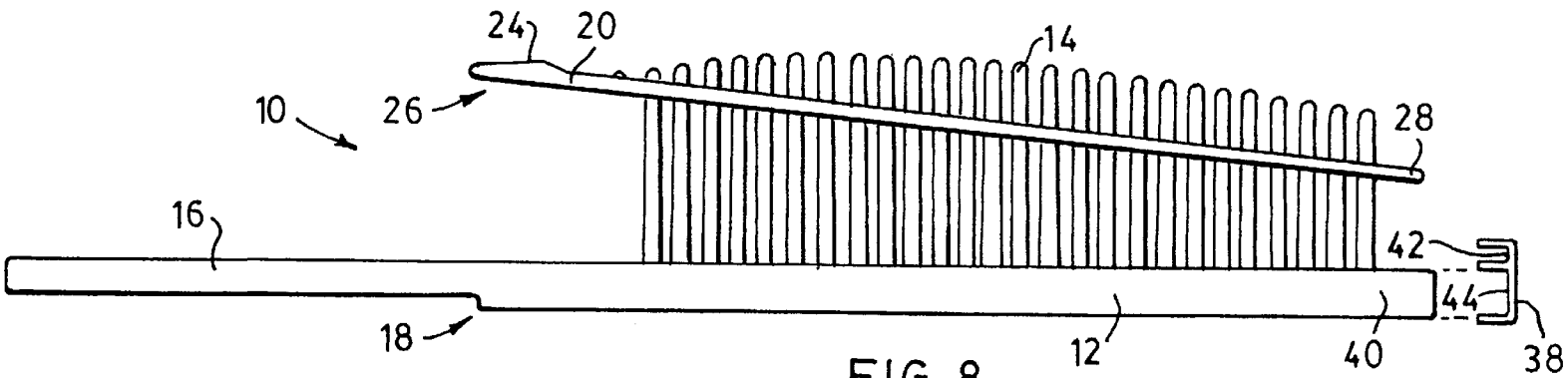
FIG. 8

10
12
14
16
18
20
22
22
24
26
28
32
34
34
36
38
40
42
44

HAIRBRUSHES, COMBS, OR THE LIKE HAVING A CLEANING PLATE

FIELD OF THE INVENTION

This invention relates to hairbrushes, combs, or other like hairdressing implements, that have a cleaning plate to remove debris, such as hair, dandruff, or other material, that collects between the bristles during use.

BACKGROUND OF THE INVENTION

For hygienic reasons, it is desirable to remove debris, such as hair, dandruff, or other material, that collects between the bristles of a brush, comb, or other like hairdressing implement. One example of a cleaning attachment for a hairbrush is shown in U.S. Pat. No. 3,172,139. This patent discloses the use of a fork-shaped cleaning plate having a plurality of tines or prongs that are normally disposed between the rows of bristles on the brush, and are movable through the rows of bristles to sweep and pull loose hairs from the bristles. In this invention the fork-shaped cleaning plate is pivotally connected to the hairbrush at one end of the base of the hairbrush.

U.S. Pat. No. 5,603,137, shows use of a fork-shaped cleaning plate having a plurality of tines which move through and pull loose hairs from the bristles of the hairbrush. In this invention, however, the handle portion has the tines projecting from one end, while the base has parallel tracts of complementary grooves running between adjacent rows of bristles. The grooves receive the tines and releasably secure the handle to the base of the hairbrush.

This invention relates to hairbrushes, combs, or other like hairdressing implements, that feature a cleaning plate releasably secured to the hairbrush, comb, or other like hairdressing implement, as the case may be, for removing debris, such as hair, dandruff, or other material, that collects between the bristles during use.

SUMMARY OF THE PRESENT INVENTION

Accordingly, the preferred embodiment of this invention provides for a hairbrush having a base and a plurality of bristles extending away from the base. A cleaning plate is provided having a cleaning element that can be slideably disposed near the base between adjacent pairs of bristles so that it can be displaced away from the base to remove hair, dandruff or other debris that collects between the bristles during use of the hairbrush. A releasable lock is also provided to releasably secure the cleaning plate to the base of the hairbrush.

The releasable lock includes a first locking part on at least one of the plurality of bristles and a complimentary second locking part to the first locking part on the cleaning plate. This complementary second locking part is positioned to releasably engage the first locking part when the cleaning element is slideably disposed near the base between adjacent pairs of bristles.

In the preferred embodiment, the first locking part on at least one of the plurality of bristles is a stem which the complimentary second locking part releasably engages. In particular, the complimentary second locking part comprises a channel having a sufficient width to releasably engage in snug fit the stem of the first locking part.

Moreover, the first locking part includes a stop located on the stem above where the complimentary second locking part releasably engages the stem. The stop engages the second locking part from above to prevent the cleaning plate from being displaced away from the base when the channel releasably engages in snug fit the stem of the first locking part.

In the preferred embodiment, the stem and the stop of the first locking part are integrally formed with the respective bristles of the hairbrush.

Further, in the preferred embodiment of the invention, the bristles of the hairbrush are arranged in a plurality of parallel rows on the base, and the cleaning element is a plurality of tines that can be slideably disposed near the base between adjacent rows of bristles. This allows the tines of the cleaning element to be displaced away from the base, to remove hair, dandruff or other debris that collects between the bristles during use of the hairbrush, and horizontal to the base, to allow easy placement of the tines near the base between adjacent rows of bristles. Moreover, the plurality of tines of the cleaning element have a sufficient longitudinal extent so that one end thereof extends beyond the parallel rows of bristles when the tines are slideably disposed near the base between adjacent rows of bristles.

In the preferred embodiment, the first locking part on at least one of the plurality of bristles is at one end of the base. Here, the ends of the plurality of tines of the cleaning element are arranged to extend beyond the parallel rows of bristles at the other end of the base. A retainer is provided to releasably secure the ends of the plurality of tines to the base at that end. This retainer is preferably a removable plate having a first channel adapted to releasably grip the ends of the plurality of tines and a second channel adapted to releasably grip the other end of the base.

It can be appreciated that the releasable lock for securing a cleaning plate to a hairbrush, as described above, is suitable for use with a variety of hairdressing implements such as hairbrushes, combs, picks, as well as grooming implements for use on animals, for example, a currycomb.

BRIEF DESCRIPTION OF THE DRAWING FIGURES

For a better understanding of the present invention and to show more clearly how it may be carried into effect, reference will now be made, by way of example, to the accompanying drawings, which show a preferred embodiment of the present invention and in which:

FIG. 5 is a partial cross-sectional view taken along line 5—5 of FIG. 3;

FIG. 6 is a partial cross-sectional view taken along line 6—6 of FIG. 4;

FIG. 7 is a partial cross-sectional view taken along line 6—6 of FIG. 4, showing the cleaning plate displaced away from the base to the tips of the bristles of the hairbrush;

FIG. 8 is a partially exploded side plan view of the hairbrush of FIG. 1 being cleaned by the cleaning plate.

DESCRIPTION OF PREFERRED EMBODIMENT

Figure 1:
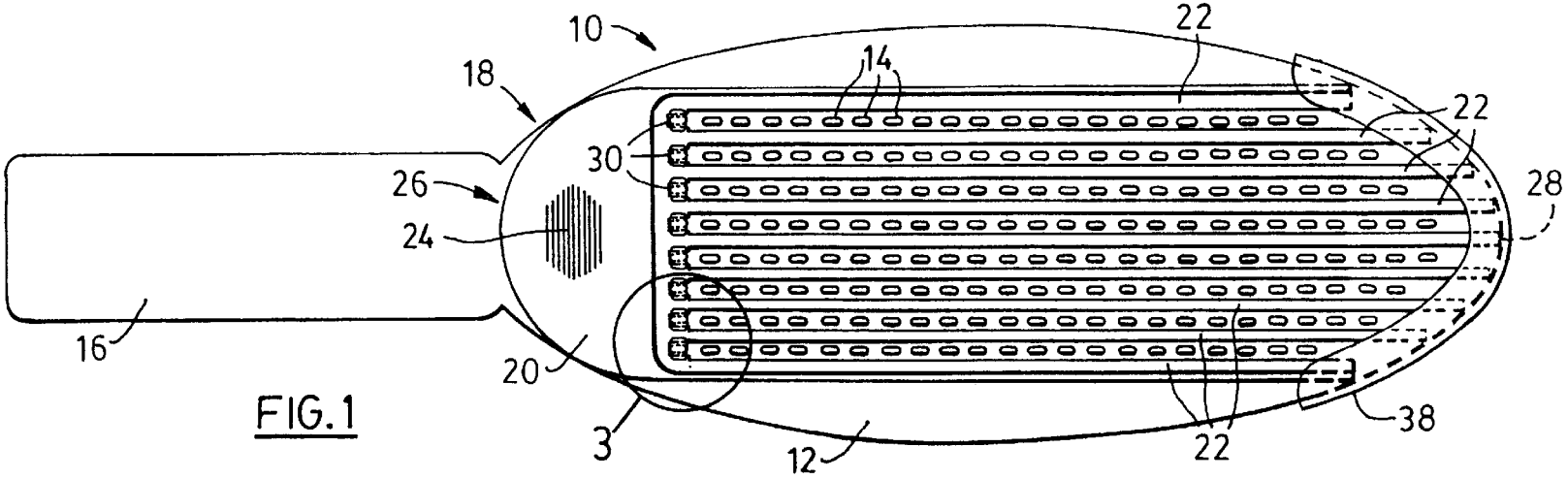
FIG. 1 is a top plan view of a brush of the present invention.

The following description will be made with reference to a cleaning plate for a hairbrush, the preferred embodiment of this invention. It is to be realized, however, that this invention is not limited to just a hairbrush, but is also intended to cover other like hairdressing implements, such as combs or picks, and even like implements used in the grooming of animals, for example, a currycomb.

In the preferred embodiment, a hairbrush 10 comprises a base 12 and a plurality of bristles 14 extending away from the base. Hairbrush 10, as illustrated in FIGS. 1 to 9 is of a construction and configuration well known in the art featuring a handle 16 extending from one end 18 of the base. The invention is not limited to a hairbrush of this construction or configuration, however.

A cleaning plate 20 is provided for removing hair, dandruff or other debris that collects between adjacent bristles 14 during use of hairbrush 10. Cleaning plate 20 includes a cleaning element, as best illustrated in FIGS. 1, 2, 8, and 9, for removing hair, dandruff or other debris that collects between adjacent bristles 14—as is well known in the art. In the preferred embodiment of the invention, the cleaning element is tines 22. Other means can be used, however, such as, for example, meshes or screens with holes for each bristle—again as is well known to those skilled in the art. Tines 22 are preferably slideably disposed near base 12 between adjacent pairs of bristles 14 so that they can be displaced away from the base (typically in the same direction that bristles 14 extend from base 12) to remove hair, dandruff or other debris that collects between adjacent bristles during use of the hairbrush. A grip 24 is provided at one end 26 of cleaning plate 20 to allow a user to hold cleaning plate 20 while displacing same away from base 12 so that tines 22 move between adjacent bristles 14 and remove hair, dandruff or other debris.

Figure 2:
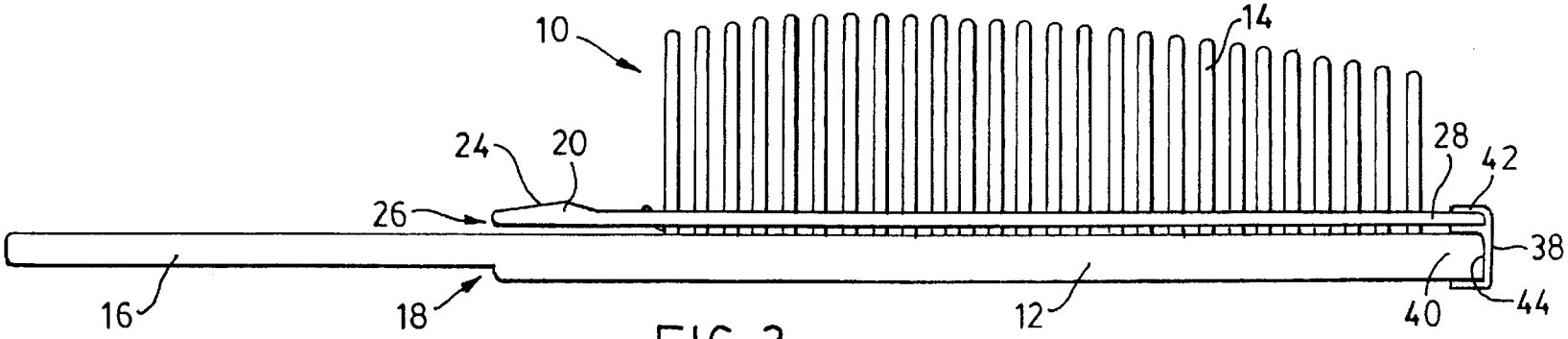
FIG. 2 is a side plan view of the brush of FIG. 1.

In the preferred embodiment of this invention bristles 14 of hairbrush 10 are arranged in a plurality of parallel rows. Accordingly, the cleaning element is a plurality of tines 22 which are slideably disposed near base 12 between adjacent rows of bristles 14. This allows cleaning plate 20 to be slideably displaceable in a direction horizontal to the base as well as away from the base with the bristles. Moreover, the plurality of tines 22 of cleaning plate 20 have a sufficient longitudinal extent so that one end 28 thereof extends beyond the parallel rows of bristles 14, as best illustrated in FIGS. 2 and 8.

Figure 3:
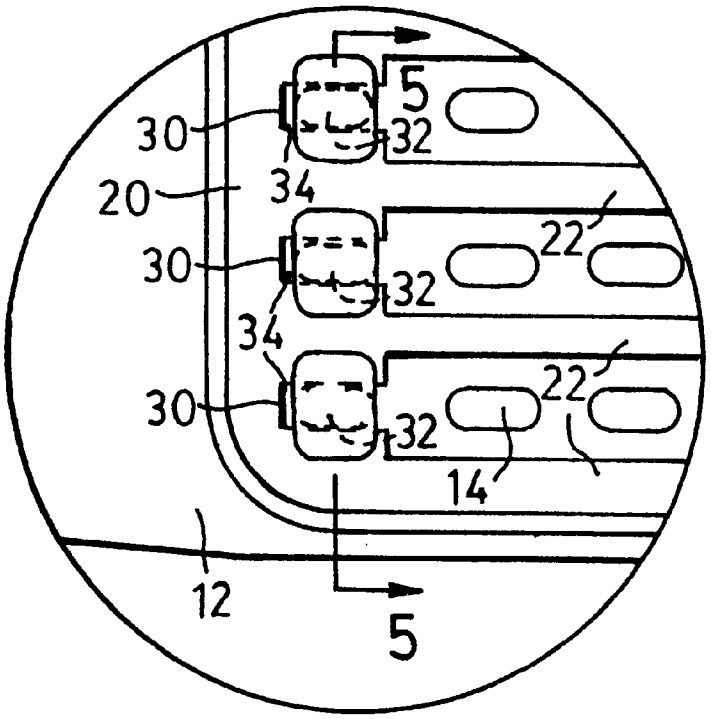
FIG. 3 is a magnified view of the area indicated by reference numeral 3 on FIG. 1, showing the first locking part of the releasable lock releasably engaging the complementary second locking part.
Figure 9:
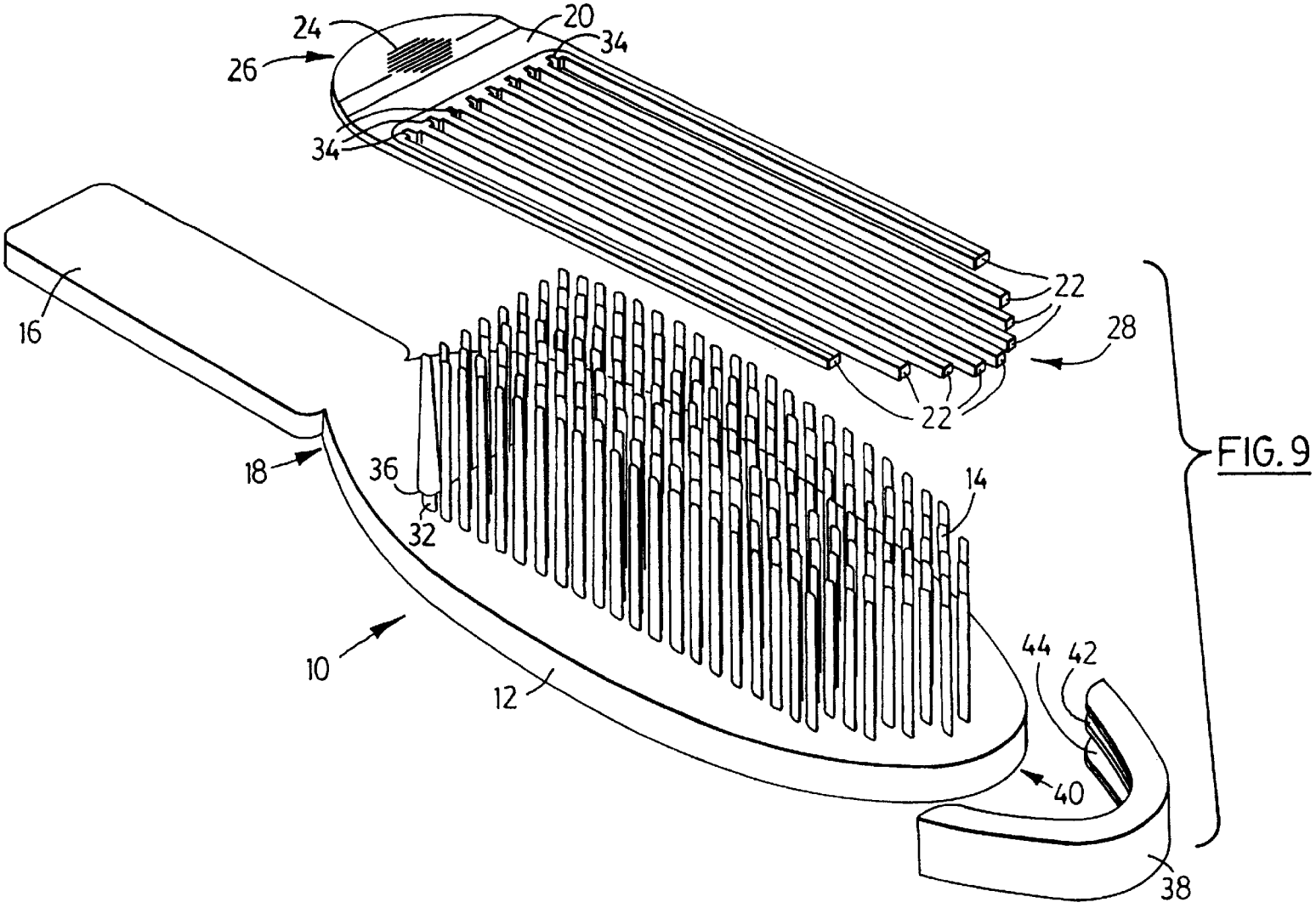
FIG. 9 is an exploded perspective view of the brush and cleaning plate of the invention.

Releasable lock 30 of this invention is best illustrated by FIGS. 3 to 7, inclusive. Releasable lock 30 includes a first locking part, which, in the preferred embodiment, includes a stem 32 formed on at least one of the plurality of bristles 14, as best illustrated in FIGS. 5 to 7, inclusive. A complimentary second locking part to the first locking part is provided on cleaning plate 20 and is positioned to releasably engage the first locking part when tines 22 are slideably disposed near the base between adjacent pairs of bristles. In the preferred embodiment complimentary second locking part comprises a channel 34 having a sufficient width to releasably engage in snug fit stem 32 of the first locking part, as best illustrated in FIG. 3. It is within the purview of those skilled in the art to use the proper materials and provide the right tolerances so that when channel 34 releasably engages in snug fit stem 32 cleaning plate 20 is held in place with its tines disposed near the base between adjacent pairs of bristles.

In the preferred embodiment the first locking part further includes a stop 36, best illustrated in FIG. 7, located on stem 32 above where channel 34 releasably engages stem 32. It can be appreciated that stop 36 will further assist in holding cleaning plate 20 in place by engaging from above tines 22 in the regions adjacent channels 34.

As can be appreciated from FIGS. 5 to 7, inclusive, stem 32 and stop 36 of the first locking part are integrally formed on and with bristles 14 which are part of releasable lock 30. Such an integrated structure would allow for relatively easy manufacture of the bristles which are part of the releasable lock.

Figure 4:
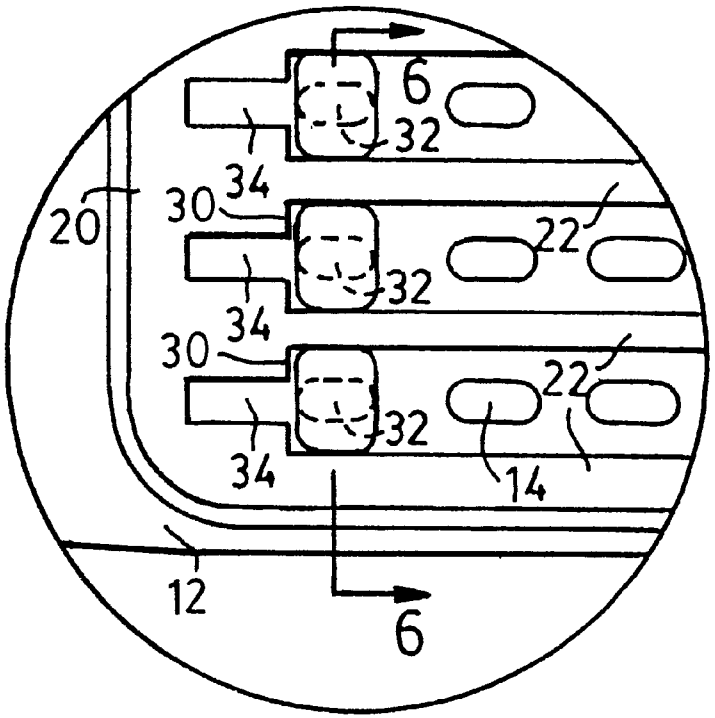
FIG. 4 is a magnified view of the area indicated by reference numeral 3 on FIG. 1, showing the first locking part of the releasable lock free of the complementary second locking part.

Moreover, in the preferred embodiment of this invention, the plurality of bristles which are part of releasable lock 30 are provided at one end 18 of base 12, as best illustrated in FIGS. 1, 3, and 4. To assist in holding cleaning plate 20 in place near base 12 a retainer 38 is provided, as best illustrated in FIGS. 2 and 8. Retainer 38 releasably secures ends 28 of the plurality of tines 22 to end 40 of base 12, which, in the preferred embodiment, is opposite end 18 of base 12. Retainer 38 is, in the preferred embodiment a removable plate having a first channel 42 adapted to releasably grip ends 28 of the plurality of tines 22, and a second channel 44 adapted to releasably grip end 40 of base 12.

In use, then, cleaning plate 20 is slideably disposed near base 12 with tines 22 between adjacent bristles 14, and, in the preferred embodiment, between adjacent parallel rows of bristles 14 (see FIG. 1).

Hairbrush 10 is then used as normal. When a user wishes to clean the accumulated hair, dandruff, and other debris from between bristles 14, they first remove retainer 38 from its releasable grip with end 28 of tines 22 and end 40 of base 12. Next, the user applies a force to grip 24, sliding cleaning plate 20 towards handle 16. By sliding cleaning plate 20 towards handle 16, channel 34 of the second locking part detaches from its snug fit with stem 32 of the first locking part (see FIGS. 4 and 6). Cleaning plate 20 is now no longer attached to hairbrush 10 and may be freely moved so that tines 22 are displaced away from base 12 between adjacent bristles 14, or, in the preferred embodiment, adjacent rows of bristles 14 (see FIGS. 7 and 8). This motion cleans the accumulated hair, dandruff, and other debris from between bristles 14, as is well known in the art. The cleaning plate 20 may then be washed and returned to the hairbrush by, in the preferred embodiment, horizontally sliding tines 22 through adjacent parallel rows of bristles 14 near base 12 until channel 34 of cleaning plate 20 releasably engages in snug fit stem 32 just below stop 36 (see FIGS. 3 and 5). Retainer 38 is then releasably secured over ends 28 of tines 22 and end 40 of base 12.

It can be appreciated that variations to this invention would be readily apparent to those skilled in the art, and this invention is intended to include those alternatives.

What is claimed is:

1. A hairbrush comprising a base;

a plurality of bristles extending away from the base;

a cleaning plate having a cleaning element that can be slideably disposed near the base between adjacent pairs of bristles so that it can be displaced away from the base; and a releasable lock including a first locking part located near the base on at least one of said plurality of bristles; and a complimentary second locking part to said first locking part on said cleaning plate and positioned to releasably engage said first locking part when said cleaning element is slideably disposed near the base between adjacent pairs of bristles.

2. A hairbrush according to claim 1 wherein said first locking part on at least one of said plurality of bristles is a stem which said complimentary second locking part releasably engages.

3. A hairbrush according to claim 2 wherein said complimentary second locking part comprises a channel having a sufficient width to releasably engage in snug fit said stem of said first locking part.

4. A hairbrush according to claim 3 wherein said first locking part further includes a stop located on the stem above where said complimentary second locking part releasably engages said stem to engage said second locking part from above and prevent said cleaning element from being displaced away from the base.

5. A hairbrush according to claim 4 wherein said stem and said stop of said first locking part are integrally formed with such bristles.

6. A hairbrush according to claim 5 wherein said bristles are arranged in a plurality of parallel rows and said cleaning element is a plurality of tines that can be slideably disposed near the base between adjacent rows of bristles so that they can be displaced away from the base and horizontal to the base.

7. A hairbrush according to claim 6 wherein said plurality of tines have a sufficient longitudinal extent so that one end thereof extends beyond said parallel rows of bristles when said tines are slideably disposed near the base between adjacent rows of bristles.

8. A hairbrush according to claim 7 wherein said first locking part on at least one of said plurality of bristles is at one end of said base.

9. A hairbrush according to claim 8 wherein the ends of the plurality of tines extend beyond the parallel rows of bristles at the other end of said base, and a retainer is provided to releasably secure the ends of the plurality of tines to said base at that end.

10. A hairbrush according to claim 9 wherein said retainer is a removable plate having a first channel adapted to releasably grip the ends of the plurality of tines and a second channel adapted to releasably grip the other end of said base.

11. A releasable lock for releasably securing a cleaning plate to a hairdressing implement wherein the hairdressing implement comprises a base and a plurality of hair-grooming members extending away from the base, and the cleaning plate has a cleaning element that can be slideably disposed near the base between adjacent pairs of hair-grooming members so that it can be displaced away from the base, said releasable lock comprising:

a first locking part located near the base on at least one of said plurality of hair-grooming members; and a complimentary second locking part to said first locking part on said cleaning plate and positioned to releasably engage said first locking part when said cleaning element is slideably disposed near the base between adjacent pairs of hair-grooming members.

12. A releasable lock according to claim 11 wherein said first locking part on at least one of said plurality of hair-grooming members is a stem which said complimentary second locking part releasably engages.

13. A releasable lock according to claim 12 wherein said complimentary second locking part comprises a channel having a sufficient width to releasably engage in snug fit said stem of said first locking part.

14. A releasable lock according to claim 13 wherein said first locking part further includes a stop located on the stem above where said complimentary second locking part releasably engages said stem to engage said second locking part from above and prevent said cleaning element from being displaced away from the base.

15. A releasable lock according to claim 14 wherein said stem and said stop of said first locking part are integrally formed with such hair-grooming members.

* * * * *